US005491671A

United States Patent [19]

Potter

[11] Patent Number: 5,491,671

[45] Date of Patent: Feb. 13, 1996

[54] SONAR TRANSDUCER WITH UNITARY ISOLATOR

[75] Inventor: Allan F. Potter, Kirkland, Wash.

[73] Assignee: Alliant Techsystems Inc., Hopkins, Minn.

[21] Appl. No.: 129,411

[22] Filed: Nov. 27, 1987

Related U.S. Application Data

[63] Continuation-in-part of Ser. No. 604,241, Apr. 26, 1984, abandoned.

[51] Int. Cl.[6] ..... H04R 17/00

[52] U.S. Cl. ..... 367/158; 367/165; 367/176

[58] Field of Search ..... 367/1, 153, 155, 367/157, 158, 162, 165, 167, 172, 173, 176, 180, 188, 191; 181/112; 114/20.1, 20.2, 21.1, 21.2; 310/337

[56] References Cited

U.S. PATENT DOCUMENTS

| | | | |
|---|---|---|---|
| 2,527,217 | 10/1950 | Hayes | 367/157 |
| 2,897,475 | 7/1959 | Harris | 367/172 X |
| 3,074,224 | 2/1963 | Laurent | 367/167 X |
| 3,082,401 | 3/1963 | Bland et al. | 114/20.1 |
| 3,191,141 | 6/1965 | Schuster | 367/911 X |
| 3,205,476 | 9/1965 | Massa | 367/157 |
| 3,262,093 | 7/1966 | Junger et al. | 367/167 X |
| 3,368,192 | 2/1968 | Graham et al. | 367/176 X |
| 3,539,980 | 11/1970 | Massa | 367/167 X |
| 3,716,828 | 2/1973 | Massa | 367/157 |
| 3,952,216 | 4/1976 | Madison et al. | 367/155 X |
| 3,972,018 | 7/1976 | Erickson | 367/167 X |
| 4,151,437 | 4/1979 | Tocquet | 367/167 X |
| 4,192,246 | 3/1980 | Hodges et al. | 114/20.1 X |
| 4,259,732 | 3/1981 | Anderson et al. | 367/13 |
| 4,364,117 | 12/1982 | Snow | 367/162 X |
| 4,731,763 | 3/1988 | Wagner | 367/153 |

*Primary Examiner*—Charles T. Jordan
*Assistant Examiner*—Theresa M. Wesson
*Attorney, Agent, or Firm*—Roger W. Jensen

[57] ABSTRACT

A vibration isolator for a torpedo transducer, comprising a unitary metallic member having an axis, a central aperture extending axially to receive the transducer, a first plurality of pairs of transverse slots extending into the member in opposite directions to terminate short of the center of the member, and a second plurality of pairs of transverse slots extending into the member in opposite directions orthogonal to the first named directions, to terminate short of the center of the member, the pairs being spaced axially and alternately along the member.

3 Claims, 3 Drawing Sheets

SONAR TRANSDUCER WITH UNITARY ISOLATOR

The U.S. Government has rights in this invention pursuant to Contract No. N00024-79-C-6277 awarded by the Department of the Navy.

FIELD OF THE INVENTION

This application is a continuation-in-part of Ser. No. 604,241, filed Apr. 26, 1984, now abandoned.

This invention relates to the field of marine engineering, and specifically to sonar transducers for use in shock hardened arrays for installation in air-launched underwater vehicles, e.g., air-launched torpedoes.

BACKGROUND OF THE INVENTION

Underwater vehicles such as torpedoes may include sonar transducers for sending and receiving sonar signals. These transducers must be acoustically coupled to the water in which the vehicle moves, but must also be protected from the very considerable pressure variations encountered at various ocean depths, and particularly must be protected from enormous momentary impact forces occurring during launching, especially when the launching is from aircraft. It is also critical to isolate such transducers from vibrations associated with the torpedo per se, e.g., vibrations produced by the engines or propulsion means or by the movement of the torpedo through the water.

BRIEF SUMMARY OF THE INVENTION

The present invention provides an improved vibration isolator for mounting a sonar transducer in a vehicle. It comprises, in the preferred embodiment, a unitary elongated square-shaped metallic spring member having an axial opening or bore for receiving a cylindrically shaped sonar transducer element; the member having first pairs of narrow transverse cuts or slits directed toward the axis in opposite directions but terminating short of the axis, and second similar pairs of narrow transverse cuts or slits axially displaced extending in directions orthogonal to the directions of the first mentioned cuts.

My invention has several very desirable features. First, my improved vibration isolator provides a mounting for a sonar transducer permitting same to function in both an active or transmitting mode of operation as well as a passive or listening mode of operation; the mounting is characterized by isolating the transducer from substantially all undesired vibrations including, very importantly, vibrations produced by the host torpedo, e.g., engine vibrations. Second, my isolator is inherently very rugged and is able to withstand very large short term impact forces such as that experienced on the nose of a torpedo when it is air launched into the sea. Third, my isolator will accommodate the sonar transducer being used in torpedo applications for operation in water down to a predetermined depth, i.e., the isolator will permit the transducer to function, as aforesaid, in either an active or passive mode down to such depth, below which the slits are closed. In the preferred embodiment, the narrow transverse slits are made by a small saw blade, in a solid beryllium—copper bar to produce a series of cantilever springs connected in series, the total spring and transducer system being designed to have a resonant frequency which is below the operating frequency band of the transducer. This provides the needed vibration isolation feature for the transducer.

In a hostile environment, such as water entry shock, the narrow slits are designed to close up producing a bending stress in each series spring within the bar which is safely below the yield stress for the material.

Since the series connected cantilever spring system is linear and consists of a relatively simple metal structure, the stiffness of this isolator remains essentially constant as the transducer water depth is increased. Increasing hydrostatic pressure presses the sides of the narrow slits closer and closer together as transducer submerged depth is increased until the narrow slits completely close. Thus the maximum operating depth of transducer is the point at which the narrow slits are not quite closed. If the transducer is submerged deeper that this up to some safe depth, it will survive and can be operated as an efficient transducer once again above the depth where the narrow slits are not closed. For convenience, the foregoing characteristics are called spring characteristics.

Changes in temperature have negligible effect on the isolator since the changes in stiffness of the metal material are very small. Thus the change in transducer operating parameters, as a function of temperature changes, are negligible.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWINGS

In the drawing, in which like reference numerals identify corresponding parts throughout the several views.

DETAILED DESCRIPTION OF THE PREFERRED EMBODIMENT

Figure 1:
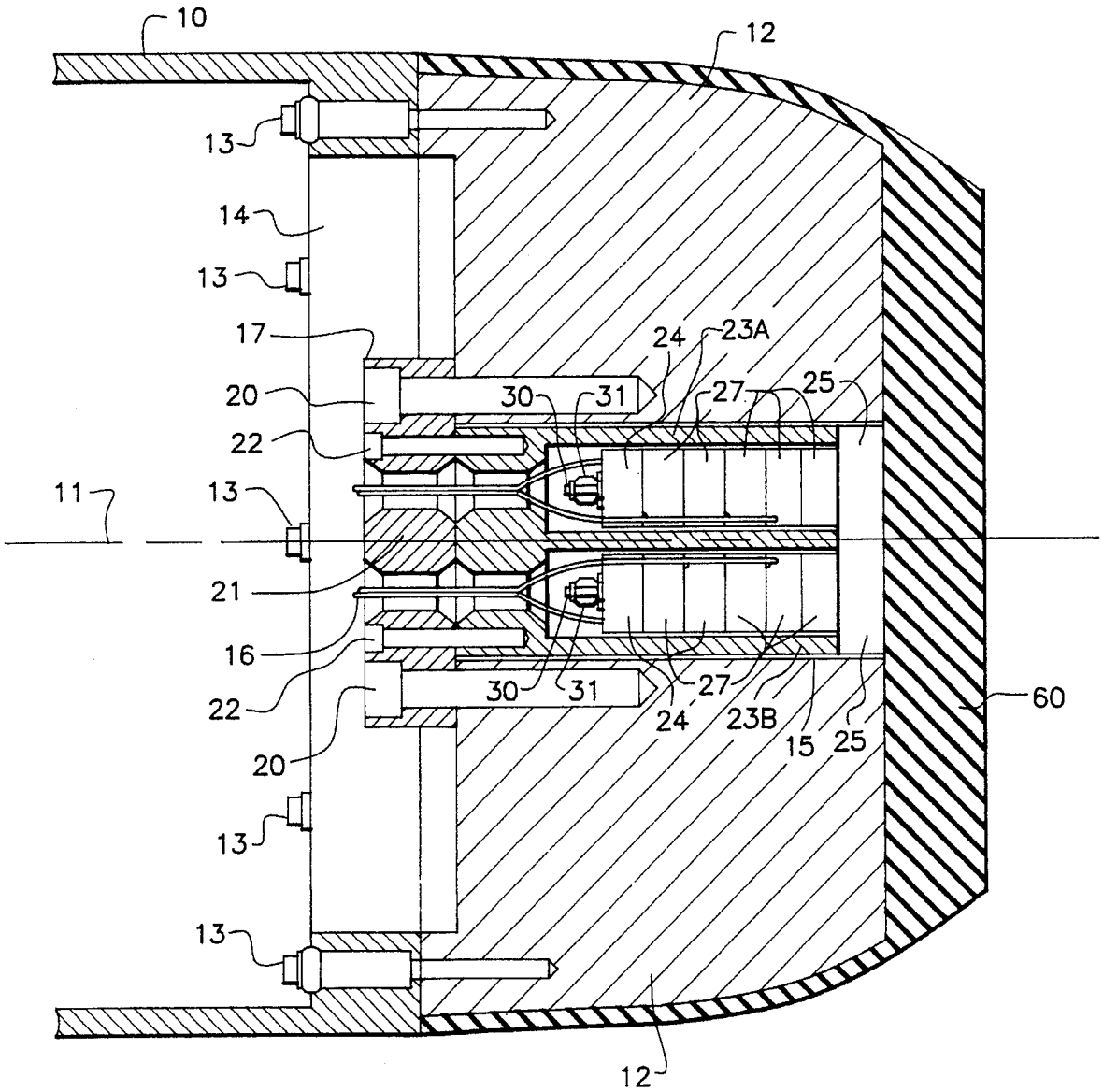
FIG. 1 is a longitudinal sectional view of an underwater vehicle having transducers according to the invention.
Figure 3:
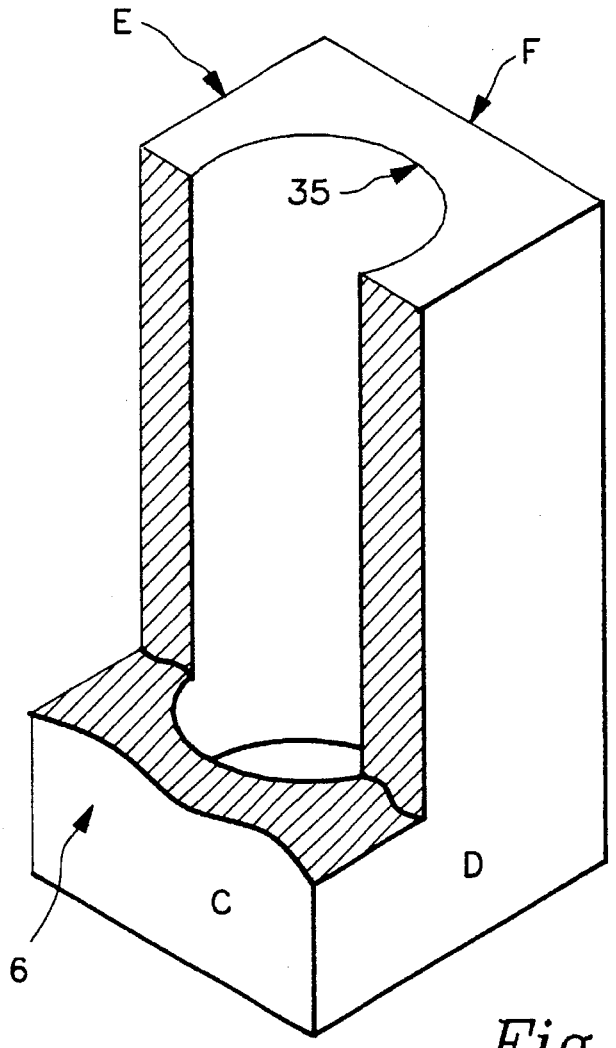
FIG. 3 is an isometric view, partly in section, of the isolator blank, prior to the slot forming process.
Figure 4:
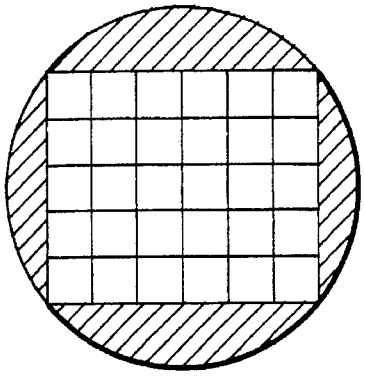
FIG. 4 is a front view of a torpedo (with nose cover removed) depicting 30 transducer elements with square shaped isolators arranged in a 6×5 grid.
Figure 5:
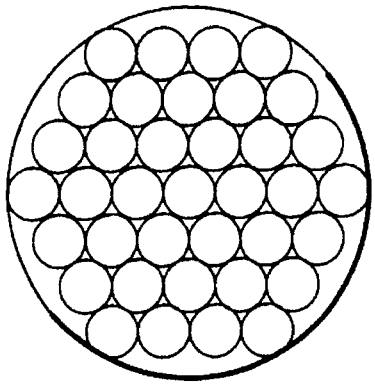
FIG. 5 shows a front view of a torpedo having a grid of circular shaped transducer elements with associated circularly shaped vibration isolators.

In the drawing a torpedo housing 10 having a longitudinal axis 11 is closed at its nose or forward end by an end plate 12 of substantial axial length mounted by fasteners 13 on a flange 14 of housing 10. Plate 12 may be an aluminum block and is centrally apertured at 15 to receive a transducer assembly 16 which includes a mount 17 secured to plate 12 by fasteners 20. Reference numeral 21 designates a base means for one or a plurality of transducers; transducer base means 21 is secured to mount 17 by fasteners 22, and supports a plurality of isolators each of which carry transducers. More specifically, FIG. 1 shows a pair of isolators 23A and 23B attached at their left end (as shown in the figure) to the mount 17 by a plurality of appropriate fasteners 22. Those skilled in the art will understand that the number of transducers to be used is a matter of design choice. The cross-sectional view of FIG. 1 shows only two such transducers positioned in parallel abutting relationship. FIG. 4 is an example of how a total of thirty transducers might be arranged in a grid or an array, i.e., five parallel rows of transducers with six transducers in each row. As will be explained in greater detail below, the invention may be incorporated into isolators other than those having the square shape shown in FIG. 3 and in FIG. 2. FIG. 5 for example is a showing of thirty-seven transducers having a circular cross-section, i.e., where both the isolators and the transducers contained within have a circular cross-section.

The square shapes shown clearly in FIG. 4 lend themselves very efficiently to a tight packing factor and also tend to facilitate manufacture from other standpoints. It will be understood, however by those skilled in the art that the basic isolator spring member may have from a minimum of three sides up to and including an effective infinite number of sides depicted in the round units of FIG. 5. By way of further example, it would be appreciated that transducer isolator springs having a hexagon cross-section would permit a tight packing into a honeycomb like appearance.

Figure 2:
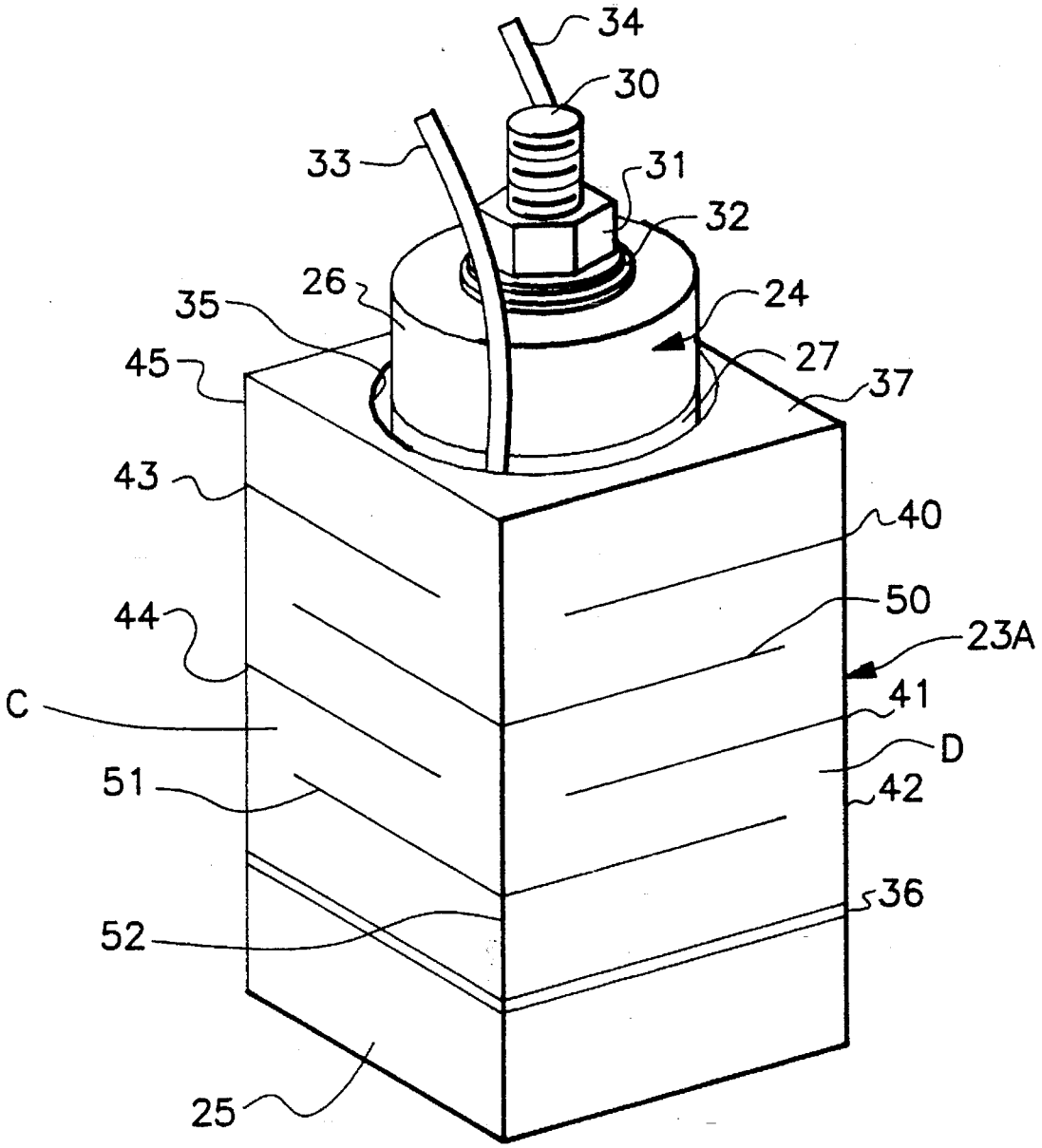
FIG. 2 is a perspective view of an isolator including such a transducer.

FIG. 2 shows isolator 23A of FIG. 1 in greater detail; it will be understood that the comments for isolator 23A apply also to isolator 23B since all units are identical. The isolator spring 23A is fabricated from a blank 6 shown in FIG. 3 the exterior of which has a square cross-section, i.e., having four faces identified in FIG. 3 by the designators CDE and F. Blank 6 further has a central circular bore 35 extending therethrough; bore 35 has a diameter slightly larger than diameter of the cylindrically shaped transducer assembly, to be described below defining a gap or clearance therebetween which is clearly visible both in FIG. 2 and in FIG. 1.

Isolator 23 is made of a square unitary bar of suitable spring material such as beryllium copper and is furnished with a plurality of transverse slits extending inwardly but terminating short of the longitudinal axis of the bar. Thus, cuts 40 and 41 extend into the bar from a first corner 42 in paired apposition with other cuts 43 and 44 extending from a second corner 45, the cuts being orthogonal to the axis of the bar. Similar cuts 50 and 51 extend into the bar from a further corner 52, in paired apposition with further cuts not shown in the figure: these cuts are also orthogonal to the bar axis, and extend into the bar in opposite directions which are orthogonal to the directions of cuts 40, 41, 43 and 44. The pairs of cuts are spaced alternately along the axis of the bar.

Following the cutting or otherwise forming of the slits or slots in the isolator blank 6, one end of the isolator spring is attached to a head mass 25 by welding or other appropriate attachment means. The head mass 25 as shown in FIG. 2 and in FIG. 1 has a square cross-section of essentially the same dimensions as the cross-section of the isolator spring. A bolt 30 is connected at one end (not shown) to the head mass 25 and extends normal thereto coaxially with regard to the bore 35 of the spring 23A and extends axially beyond the other end 37 of the isolator spring. A plurality of washer-like or apertured discs having piezoelectric properties such as barium titanate ceramic 27 are stacked in axially abutting relationship (see FIG. 1) on the bolt 30. Five such piezoelectric elements are shown for each transducer of FIG. 1; those skilled in the art will recognize that the number of piezoelectric elements may vary according to the application. Referring to FIG. 2, a tail mass 24 is held in tight abutting relationship with the disc 27 shown in that view, the entire assembly of discs 27 and the tail mass 24 being held under appropriate axial pressure by coaction of a nut 31 and washer means 32 on the bolt 30. Electrical connections to the piezoelectric elements 27 are provided by conductors 33 and 34.

In one embodiment of the invention the axial length of the isolator was 1.25 inches, its sides were 1.132 inches, and the slots were 0.01 inches wide and were spaced about 0.25 inches. When mounted on base 21 in aperture 15, the free ends of head masses 25 are flush with end plate 12, and an acoustical window 60 or rubber boot is molded on the end of the vehicle to give protection against entry of water while allowing independent operation of the transducers to transmit and receive sonar signals.

Numerous characteristics and advantages of the invention have been set forth in the foregoing description, together with details of the structure and function of the invention, and the novel features thereof are pointed ,out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

I claim:

1. In a transducer assembly for a torpedo wherein said assembly comprises a plurality of individual transducers, each of said transducers having dual functions of (i) producing a mechanical output as a function of an applied electrical signal, and (ii) producing an electrical signal as a function of an applied mechanical signal, and each of said transducers comprising a head mass, a tail mass, and at least one piezoelectric element interposed between said head mass and said tail mass, said transducers when used to produce an electrical signal, as aforesaid, having a normal range of operating frequencies of applied mechanical signals, and each of said transducers being attached to said torpedo by an improved mounting means and vibration isolator comprising:

an elongated unitary metallic member having a longitudinal axis, a central aperture extending axially between first and second axially spaced apart ends, said aperture being adapted to receive an assembled transducer tail mass and at least one piezoelectric element with a head mass integral therewith being connected in abutting relationship with said first of said spaced apart ends of said member, said mounting means further comprising a first plurality of pairs of apposed slots extending transversely into said member in opposite directions along a first transverse axis normal to said longitudinal axis to terminate short of said longitudinal axis, a second plurality of pairs of apposed slots extending transversely into said member in opposite directions along a second transverse axis normal to said longitudinal axis to terminate short of said longitudinal axis, each slot having first and second normally spaced apart faces such that for increasing static force applied to the head mass said first and second faces move from an at rest position relative to and toward one another, said transverse axes being at a preselected angular relationship, said pairs of slots being spaced axially and alternately along said members, the other of said spaced apart ends being adapted to be connected to said torpedo, said member being fabricated from a preselected metallic material and said distance between said faces of said slots being selected so that said member has spring characteristics and absorbs acoustic energy having frequencies within said normal range of operating frequencies, and said slots being preselected so that upon said static force exceeding a preselected level, said first and second faces move into mutual engagement so as to protect said piezoelectric element located in said central aperture thereof against damage, said faces being gradually returned to said at rest position for decreasing static force applied to said read mass.

2. A mounting means and vibration isolator according to claim 1 in which said spaced apart ends and said slots are orthogonal to said longitudinal axis.

3. A mounting means and vibration isolator according to claim 2 wherein each of said transverse axes and said longitudinal axis define first and second planes, said planes being normal to one other.

* * * * *